US007441846B2

(12) United States Patent
Lupo

(10) Patent No.: US 7,441,846 B2
(45) Date of Patent: Oct. 28, 2008

(54) EXPANDABLE HOME TELEVISION CART

(75) Inventor: Chris Lupo, Parker House Mfg. Co., Inc., 505 W. Foothill Blvd., Azusa, CA (US) 91702

(73) Assignee: Chris Lupo, Ontario, CA (US)

( * ) Notice: Subject to any disclaimer, the term of this patent is extended or adjusted under 35 U.S.C. 154(b) by 58 days.

(21) Appl. No.: 11/114,797

(22) Filed: Apr. 26, 2005

(65) Prior Publication Data

US 2006/0001336 A1 Jan. 5, 2006

Related U.S. Application Data

(60) Provisional application No. 60/585,468, filed on Jul. 2, 2004.

(51) Int. Cl.
*A47B 45/00* (2006.01)

(52) U.S. Cl. ..... 312/205; 312/7.2

(58) Field of Classification Search ..... 312/205, 312/204, 7.2, 257.1, 107, 111, 198, 223.3; 108/39

See application file for complete search history.

(56) References Cited

U.S. PATENT DOCUMENTS 1,928,936 A * 10/1933 Henricson ..... 312/195
2,304,490 A 12/1942 Yoder
D159,539 S * 8/1950 Schier et al. ..... D14/169
2,643,083 A 6/1953 Troutman
2,664,258 A 12/1953 Lanier
2,698,152 A 12/1954 Kaye
2,806,754 A 9/1957 Abeles
3,353,885 A * 11/1967 Hanson ..... 312/205
3,467,455 A 9/1969 Caldemeyer
3,672,741 A 6/1972 Clark
3,930,701 A 1/1976 Otakie
3,977,742 A 8/1976 Rovere
4,002,831 A 1/1977 Aeschliman
4,053,192 A 10/1977 Spetner
4,193,650 A 3/1980 Gray
4,223,967 A 9/1980 Royer
4,273,395 A 6/1981 Martinez et al.

(Continued)

FOREIGN PATENT DOCUMENTS

CH 303847 2/1955

(Continued)

OTHER PUBLICATIONS

Three pages containing one photo image each, Furniture Style Magazine, Mar. 2005, showing product of Mueblas Concordia Furniture, 11000 Parkway, Anjou, Montreal, Quebec, Canada H1J 1R6.

(Continued)

*Primary Examiner*—James O Hansen
(74) *Attorney, Agent, or Firm*—Marshall A. Lerner; Marvin H. Kleinberg; Kleinberg & Lerner, LLP

(57) ABSTRACT

An expandable cabinet furniture, especially a television cart, has laterally separable, usually rectangular solid cabinets and one or more extensions, typically shelves, slidably received in and supported by slots, rails or guides of the cabinets. The tops, shelves, or bottoms of the cabinets conceal the portions of the extensions that are received in the cabinets, either behind detail moldings or within false bottoms or hollow shelves.

5 Claims, 4 Drawing Sheets

U.S. PATENT DOCUMENTS

| | | | | |
|---|---|---|---|---|
| 4,277,120 | A * | 7/1981 | Drake et al. | 312/223.1 |
| 4,602,826 | A | 7/1986 | Zimmer | |
| 4,660,901 | A | 4/1987 | Shimada | |
| 4,669,790 | A | 6/1987 | Briggs | |
| 4,861,121 | A | 8/1989 | Gotz | |
| 4,974,386 | A | 12/1990 | Eriksson et al. | |
| 5,303,057 | A | 4/1994 | Davidow et al. | |
| 5,795,041 | A | 8/1998 | Weaver | |
| 6,283,563 | B1 * | 9/2001 | Lambright et al. | 312/205 |
| D455,028 | S | 4/2002 | Vaaler | |
| 6,402,272 | B1 | 6/2002 | Kuvshinikov | |
| 6,505,898 | B1 | 1/2003 | Buchanan | |
| 6,545,863 | B2 | 4/2003 | Huggins | |
| 6,561,599 | B2 | 5/2003 | Itakura | |
| D478,433 | S | 8/2003 | Woods | |
| D479,411 | S | 9/2003 | Nielsen | |
| D487,853 | S | 3/2004 | Woods | |
| 6,709,078 | B2 | 3/2004 | Johnson | |
| 6,709,079 | B1 | 3/2004 | Feltrin | |
| 6,796,622 | B2 | 9/2004 | Nielsen | |

FOREIGN PATENT DOCUMENTS

| | | | |
|---|---|---|---|
| JP | 2001-70051 | * | 3/2001 |

OTHER PUBLICATIONS

One page containing two photo images, Furniture Today Magazine, Jan. 2004, showing product of Laurier Furniture Ltd., 153, Laurier Bld, #100, Laurier-Station, Quebec G0S 1N0.

One page containing one photo image, Furniture Today Magazine, Apr. 2004, showing product of Signature Seay, 14104 Arbor Place, Cerritos, Ca. 90703.

One page containing five photo images, Computer Electronics Show brochure, Jan. 2005, showing product "Encore!" of APA Marketing, 280 Conestoga Way, Henderson, NV 89015.

* cited by examiner

FIG. 5
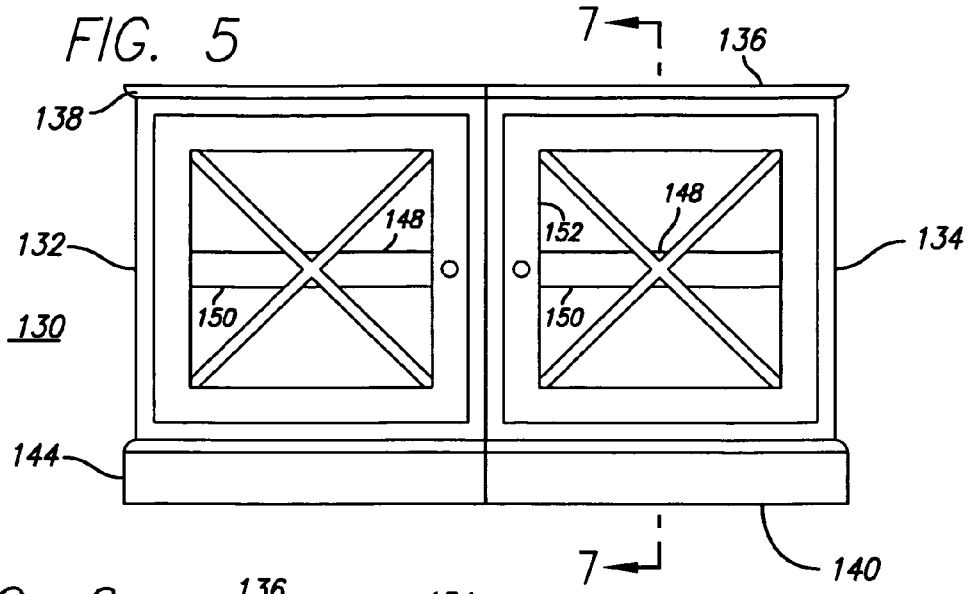
FIG. 6
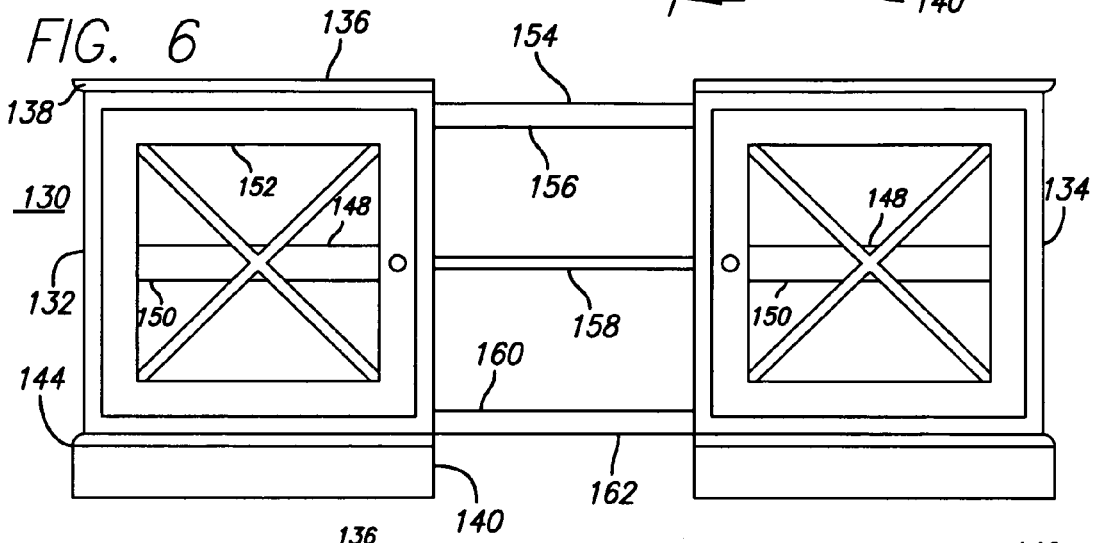
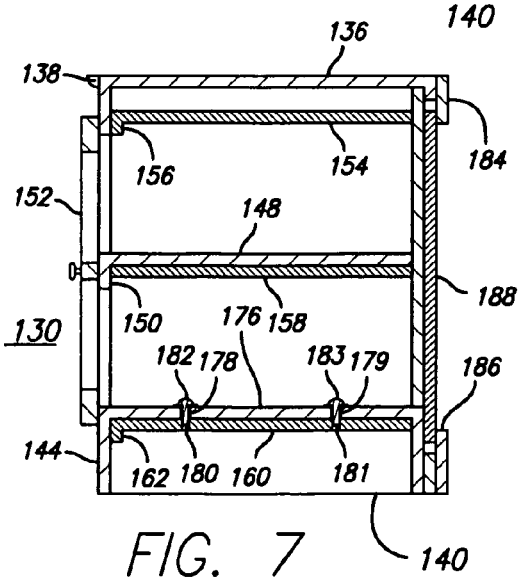
FIG. 7
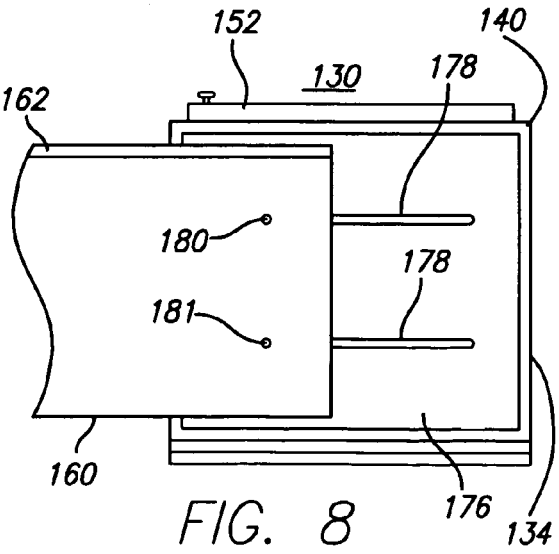
FIG. 8

EXPANDABLE HOME TELEVISION CART

This application claims the benefit of Provisional Application No. 60/585,468, filed Jul. 2, 2004.

BACKGROUND OF THE INVENTION

1. Field of the Invention

The present invention relates generally to a type of home furniture known as a television cart ("TV cart") and more particularly to a TV cart of variable width.

2. Description of the Related Art

A furniture maker may sell a TV cart without knowing the width of the buyer's television (TV). The buyer may replace the TV with one of a different width. If the cart is merely required to support the TV, it might be wider or narrower than the TV with little consequence. However, if home audio/video and consumer electronic entertainment equipment is to be housed near the TV, the consumer prefers to use space efficiently and create a pleasing appearance by surrounding the TV screen with cabinets, usable shelves, speaker towers and the like and not with odd-looking gaps and voids.

A TV space of variable width can be provided, for example, by a TV cart of fixed width at least as wide as the TV which rests on the floor and is bracketed on the left and right by cabinets or towers having sufficient void space to receive the portions of the TV cart that extend laterally beyond the width of the TV. Although this combination reduces gaps between the TV and the surrounding furniture, the cabinet void spaces occupied by the TV cart are unavailable for other uses and any portion of the TV cart that extends into a cabinet or tower is likely to be obstructed. Moreover, the portion of the TV cart that is unobstructed may be of unexpected dimensions. The consumer, not knowing what to do with this odd space and preferring not to see it, might simply cover it with a piece of fabric or screen cut to size.

A TV space of variable width can also be provided by a TV cart of variable width which rests on the floor and is bracketed by cabinets or towers. Such a TV cart will not invade the volume of a cabinet or tower, but will nevertheless have a void space and a front area of unpredictable dimensions.

Televisions today include not only CRTs, but LCDs, Plasmas, DLPs, Regular and High Definition models, Sony WEGAs and a host of other new technologies, all of which have styling with varying dimensions. A need exists for a way to house a television of any width within a range on a TV cart of variable width while preserving familiar usable space near the TV.

SUMMARY OF THE INVENTION

It is an object of the present invention to house a TV of width within a range on a TV cart of variable width while preserving familiar usable space near the TV.

In accordance with these objects and with others which will be described and which will become apparent, an exemplary embodiment of an expandable cabinet furniture in accordance with the present invention comprises first and second cabinets and at least one extension, or span, extending therebetween, at least one of the first and second cabinets enclosing an interior and receiving and concealing therein a variable portion of the at least one span. When the cabinets are spaced apart, the spans provide shelf space between the cabinets. As the cabinets are moved closer together, the spans are received in the cabinets in a manner which does not substantially lessen the visible and usable space within the cabinets.

The cabinets may contain shelves, in which case the spans may be received beneath the shelves. Moldings may depend from the shelves and hide the variable length segments of the spans that are received behind the moldings.

A span may be relatively flat like a plank. The span may be received through, or supported by, a slotted side of a cabinet.

A cabinet may receive and conceal a variable portion of a span, either behind a detail molding as mentioned above, or within a hollow shelf or some other obscuring structure.

A cabinet may receive a span through one or more of its sides.

A cabinet may receive a span against a bottom shelf or bottom surface, within a guide or rail, or against or within a false bottom panel and the span may have a bolt slidably positioned in a slot in the cabinet to guide the span. The bolt may be secured by a nut, or may be insertable into the slot through an enlarged portion of the slot.

Also in accordance with the same objects, an exemplary embodiment of an expandable television cart in accordance with the present invention comprises first and second cabinets each having a top side, each having a bottom side adapted for resting on a floor surface, each enclosing an interior space, each having a front side adapted for frontally viewing and accessing the interior space. A top bridge extends between the first and second cabinets. Variable portions of the top bridge are received within the first and second cabinets proximate the top sides thereof. A bottom bridge extends between the first and second cabinets, variable portions of the bottom bridge being received within the first and second cabinets proximate the bottom sides thereof. The variable portions of the top bridge and of the bottom bridge, received within the first and second cabinets, are substantially hidden from frontal viewing.

The cart may have a shelf at an intermediate height within the interior space. At least one intermediate bridge extends between the first and second cabinets, variable portions of the intermediate bridge being received within the first and second cabinets proximate the intermediate shelf. The variable portions of the intermediate bridge, received within the first and second cabinets, are substantially hidden from frontal viewing.

A molding may depend from the top side and from the bottom side of each of the first and second cabinets proximate the front side thereof, and the variable portion of the top bridge and the bottom bridge may be received behind the molding.

A molding may also depend from the intermediate shelf of each of the first and second cabinets proximate the front side thereof, and the variable portion of the intermediate bridge may be received behind this molding.

The top side and bottom side of the first cabinet and second cabinet may be hollow and each variable portion of the top bridge and the bottom bridge is received within the hollow top side and bottom side, respectively.

Each intermediate shelf may be hollow and each variable portion of the intermediate bridge may be received within the hollow intermediate shelf.

A back panel may extend between the first and second cabinets, variable portions of the back panel being received behind the first and second cabinets.

Also in accordance with the same objects, an exemplary embodiment of an expandable cabinet furniture comprises a support; a cabinet; and at least one span engaged endwise with the support and being concealingly received a variable distance within the cabinet. The support may include a cabinet and the span include a horizontally oriented substantially flat rigid structural member.

The present invention allows each span to extend a variable distance outside a cabinet in a manner providing shelves or other crossmembers having utility or familiar appearance. The present invention also allows the span to extend into a cabinet in a manner preserving the usefulness and familiar appearance of the space inside the cabinet. Optionally, a back panel is slidably supported at the rear of a cabinet to provide some enclosure behind the span.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein:

FIG. 5 is a front elevational view of a first alternative embodiment of an expandable cabinet furniture in accordance with the present invention with the cabinets abutting;

FIG. 6 is a front elevational view thereof with the cabinets spaced apart;

FIG. 7 is a right sectional view through a cabinet thereof taken along line 7-7 of FIG. 5;

FIG. 8 is a bottom plan view of the second cabinet thereof;

DESCRIPTION OF THE PREFERRED EMBODIMENTS

Figure 1:
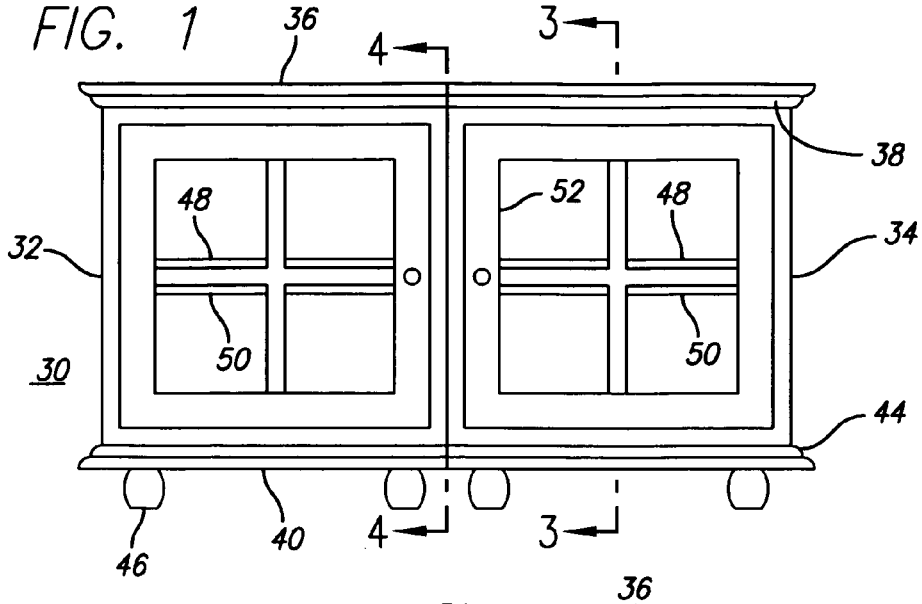
FIG. 1 is a front elevational view of a preferred embodiment of an expandable cabinet furniture in accordance with the present invention with the cabinets abutting.

The invention will now be described with reference to FIG. 1, which illustrates in front view a preferred embodiment of an expandable cabinet furniture in accordance with the present invention shown generally by the reference number 30, including a first cabinet 32 and a second cabinet 34, each having a top 36 with frontal depending top detail molding 38, a bottom 40 with frontal depending bottom detail molding 44 and feet 46, a middle shelf 48 with frontal depending middle shelf detail molding 50, and a windowed door 52. The second cabinet 34 abuts the first cabinet 32.

Figure 2:
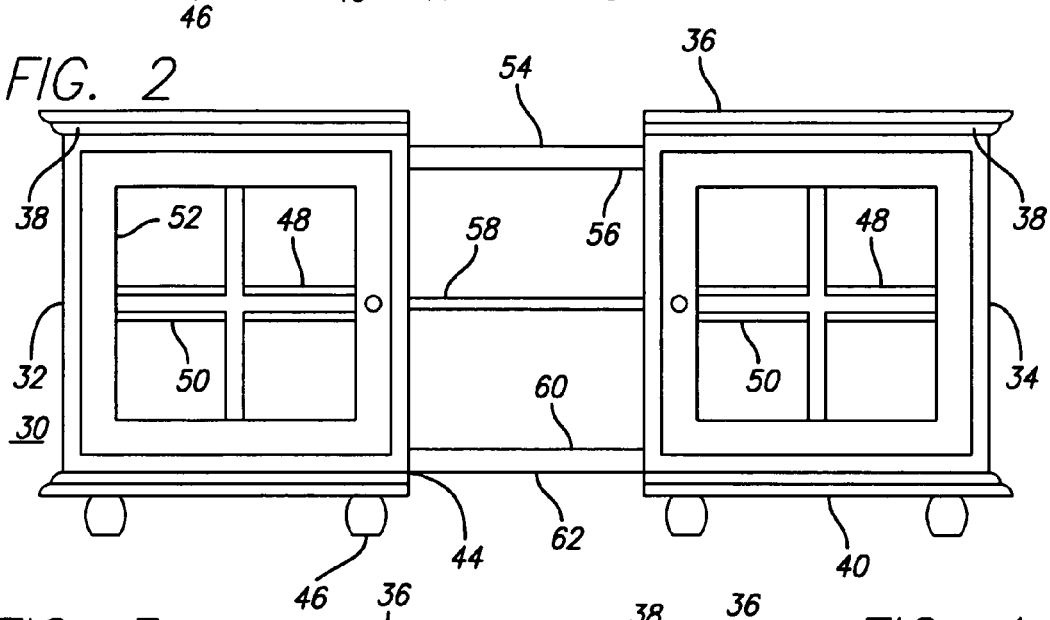
FIG. 2 is a front elevational view thereof with the cabinets spaced apart.

FIG. 2 illustrates a front elevational view with the cabinets spaced apart, showing the first cabinet 32 and second cabinet 34 each with top 36, top detail molding 38, bottom 40, bottom detail molding 44, feet 46, door 52, middle shelf 48, and middle shelf detail molding 50. Between the spaced apart first cabinet 32 and the second cabinet 34 there are a top extension 54 with top extension detail molding 56, a middle extension 58, and a bottom extension 60 with bottom extension detail molding 62.

Figure 3:
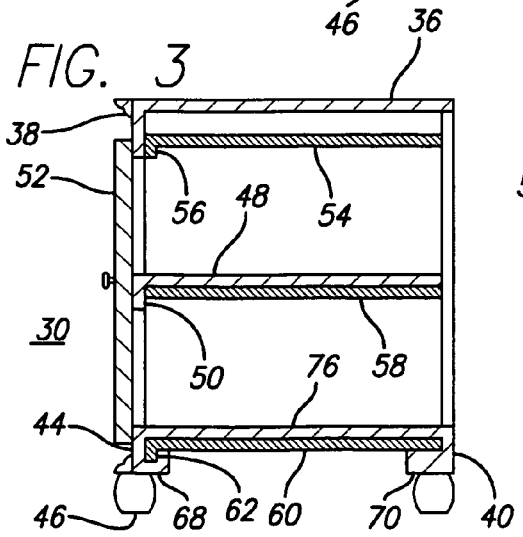
FIG. 3 is a right side sectional view through one cabinet thereof taken along line 3-3 of FIG. 1.

FIG. 3, a right side sectional view through one cabinet, shows the top 36, top detail molding 38, bottom 40, bottom detail molding 44, middle shelf 48, middle shelf detail molding 50, feet 46, door 52, top extension 54, middle extension 58, and bottom extension 60. The top extension 54 has a frontal depending top extension detail molding 56. The bottom extension 60 has a frontal depending bottom extension detail molding. The bottom 40 forms a bottom shelf 76. The bottom 40 also forms a rearward-projecting front rail 68 and a frontward-projecting rear rail 70 which cooperate to support the bottom extension 60.

Figure 4:
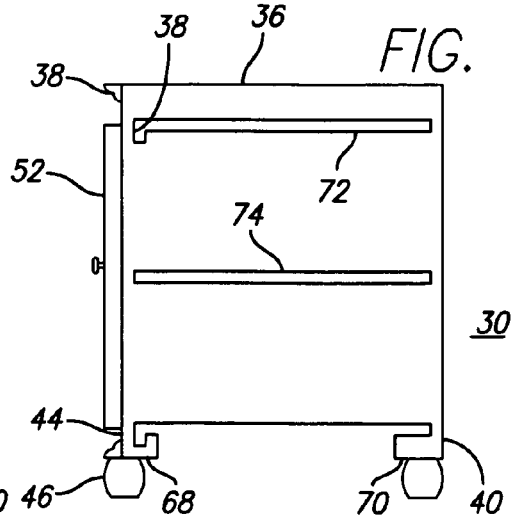
FIG. 4 is a right side elevational view of a left cabinet thereof.

FIG. 4, a right side elevational view of the first cabinet 32 (the one on the left in FIGS. 1-2), shows the top 36, top detail molding 38, bottom 40, bottom detail molding 44, door 52, feet 46, front rail 68, and rear rail 70. Also shown are a top cut-out 72 for receiving and supporting the top extension (not shown; see FIGS. 2-3), and a middle cut-out 74 for receiving and supporting the middle extension (not shown; see FIGS. 2-3).

With reference to FIGS. 1-4, the first cabinet 32 and the second cabinet 34 may be placed in abutment or they may be spaced apart a variable distance. To accommodate the distance, the top extension 54 slides in the top cut-out 72, the middle extension 58 slides in the middle cut-out 74, and the bottom extension 60 slides on the front rail 68 and rear rail 70. The middle shelf 48 and the bottom shelf 76 provide for the familiar and aesthetically pleasing storage, organization or display of articles within the first cabinet 32 and second cabinet 34. The top detail molding 38, bottom detail molding 44, and middle shelf detail molding 50 provide visual features, both familiar and aesthetically pleasing, which may be finished in a manner consistent with whatever decorative motif is desired.

With continued reference to FIGS. 1-4, the top detail molding 38 hides the portion of the top extension 54 that is received beneath the top 36, the bottom detail molding 44 hides the portion of the bottom extension 60 that is received beneath the bottom 40, and the middle shelf detail molding 50 hides the portion of the middle extension 58 that is received beneath the middle shelf 48. As a result, those portions of the extensions 54, 60 and 58 are unlikely to be noticed and thus unlikely to disturb the aesthetics of the furniture.

With further reference to FIGS. 1-4, the spaces available for the storage, organization or display of articles within the first cabinet 32 and second cabinet 34 do not vary substantially as the extensions 54, 60 and 58 are advanced or withdrawn. Only small, inconspicuous spaces behind the top detail molding 38, bottom detail molding 44 and middle shelf detail molding 50 are affected.

With still further reference to FIGS. 1-4, the top extension 54 is usable to support a television or similar appliance. Alternatively, if the appliance includes a volume of hardware located below its video screen, the top extension 54 and, if desired, the middle extension 58 may be removed and the appliance may be supported by the middle extension 58 or by the bottom extension 60. Especially in the case of a wide flat panel television having widely spaced feet and little or no hardware beneath its video screen, the tops 36 of the left and right cabinets 32 and 34 support the appliance directly. In this arrangement, the extensions 54, 58 and 60 may appear, or indeed function, as shelf space.

Finally, with reference to FIGS. 2-3, the top extension detail molding 56 and bottom extension detail molding 60, although shaped simply in the drawing, may be shaped or finished to complement or mimic decorative features of the top detail molding 38 and the bottom detail molding 44, respectively, if desired.

FIG. 5 illustrates a front elevational view of a first alternative embodiment of an expandable cabinet furniture in accordance with the present invention in which the cabinets rest directly on the floor and lack rails. This first alternative embodiment, shown generally by the number 130 with the cabinets abutting, includes a first cabinet 132 and a second cabinet 134, each having a top 136 with frontal depending top detail molding 138, a bottom 140 with bottom detail molding 144, a middle shelf 148 with frontal depending middle shelf detail molding 150, and a windowed door 152. The second cabinet 134 abuts the first cabinet 132.

FIG. 6 illustrates a front elevational view thereof with the cabinets spaced apart. There are a first cabinet 132 and a second cabinet 134, each having a top 136, top detail molding 138, a bottom 140 with bottom detail molding 144, door 152, a middle shelf 148, and middle shelf detail molding 150. Between the spaced apart first cabinet 132 and the second cabinet 134, there is a top extension 154 with top extension detail molding 156, a middle extension 158, and a bottom extension 160 with bottom extension detail molding 162.

FIG. 7 illustrates a right sectional view through a cabinet thereof. There are the top 136, top detail molding 138, bottom 140, middle shelf 148, middle shelf detail molding 150, door 152, top extension 154, middle extension 158, and bottom extension 160. The top extension 154 has a frontal depending top extension detail molding 156. The bottom extension 160 has a frontal depending bottom extension detail molding 162. The bottom 140 forms a bottom shelf 176 having two parallel laterally oriented slots 178 and 179. The bottom extension 160 has two bolts 180 and 181 which are shown projecting upward into the slots 178 and 79 with their heads 182 and 183 above the bottom shelf 176 to slidably suspend the bottom extension 160 from the bottom shelf 176. Also shown are a top guide 184, a bottom guide 186, and a back panel 188 slidably nested between the top guide 184 and the bottom guide 186. The top guide 184 and the bottom guide 186, as shown, are formed of the same material used for the cabinets 132 and 134, but may alternatively be provided in a different form such as, for example, screw-on metal brackets. Also alternatively, the back panel 188 may alternatively be fixed to one cabinet 132 and slidingly received behind the other cabinet 134.

FIG. 8, a bottom plan view of the second cabinet 134 thereof (the one on the right in FIGS. 5-6), shows the bottom 140, door 152, bottom shelf 176, slots 178 and 179, bottom extension 160, bottom extension detail molding 162, and bolts 180 and 181.

With reference to FIGS. 5-8, the first cabinet 132 and second cabinet 134 may be placed in abutment or they may be spaced apart a variable distance. To accommodate the distance, the top extension 154 slides in the top cut-out (not shown; see top cut-out 72 in FIG. 4), the middle extension 158 slides in the middle cut-out (not shown; see middle cut-out 74 in FIG. 4), the heads 182 and 183 of the bolts 180 and 181 of the bottom extension 160 slide on the bottom shelf 176, and the back panel 188 slides between the top guide 184 and the bottom guide 186.

With continued reference to FIGS. 5-8, the bottom 140, lacking feet, allows the bottom shelf 176 to be positioned relatively close to the floor. The bottom extension 160, being supported by bolts 180 and 181 engaged with the bottom shelf 176, avoids the need for the rails 68 and 70 that are shown in FIGS. 1-4, thereby saving space and weight and reducing the cost of material and assembly.

Figure 9:
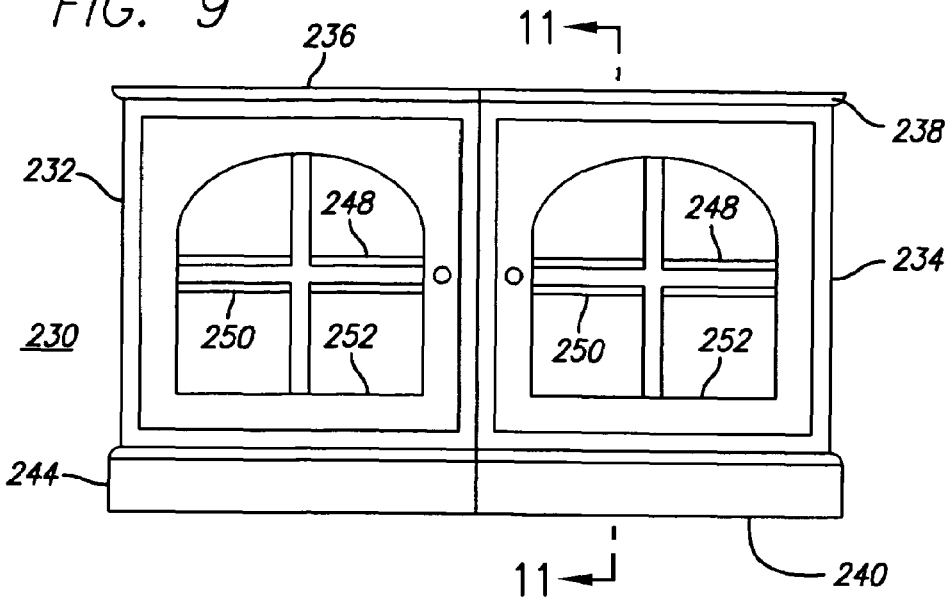
FIG. 9 is a front elevational view of a second alternative embodiment of an expandable cabinet furniture in accordance with the present invention with the cabinets abutting.

FIG. 9 illustrates a front elevational view of a second alternative embodiment of an expandable cabinet furniture in accordance with the present invention in which the bottom extension is received in a false bottom. This second alternative embodiment, shown generally by the number 230 with the cabinets abutting, includes a first cabinet 232 and a second cabinet 234, each having a top 236 with frontal depending top detail molding 238, a bottom 240 with frontal depending bottom detail molding 244, a middle shelf 248 with frontal depending middle shelf detail molding 250, and a windowed door 252. The second cabinet 234 abuts the first cabinet 232.

Figure 10:
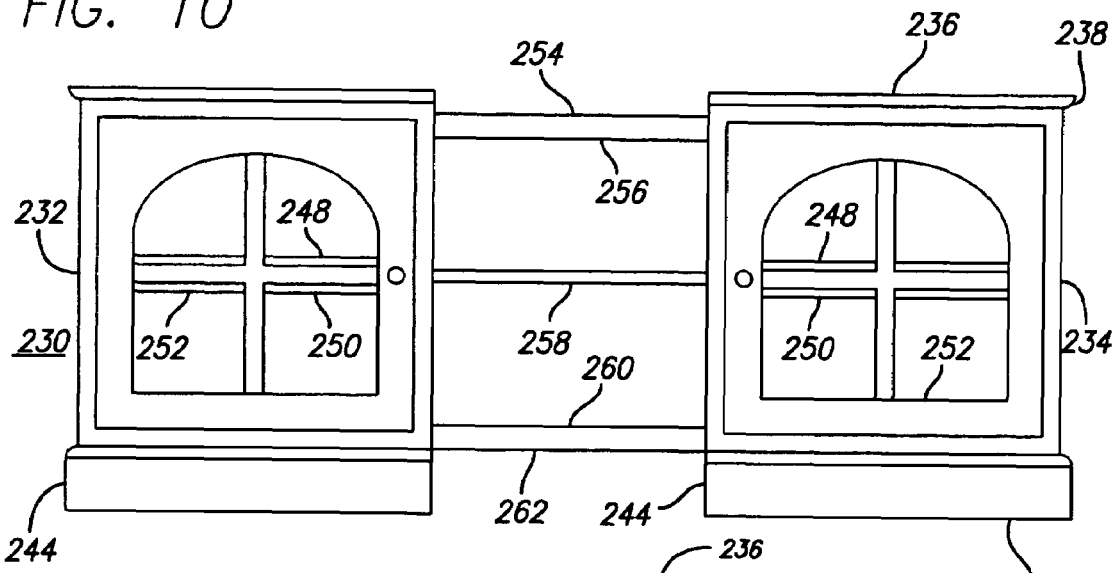
FIG. 10 is a front elevational view thereof with the cabinets spaced apart.

FIG. 10 illustrates a front elevational view thereof with the cabinets spaced apart. There are the first cabinet 232 and second cabinet 234, each with top 236, top detail molding 238, bottom 240, door 252, middle shelf 248, and middle shelf detail molding 250. Between the spaced apart first cabinet 232 and the second cabinet 234, there are a top extension 254 with top extension detail molding 256, a middle extension 258, and a bottom extension 260 with bottom extension detail molding 262.

Figure 11:
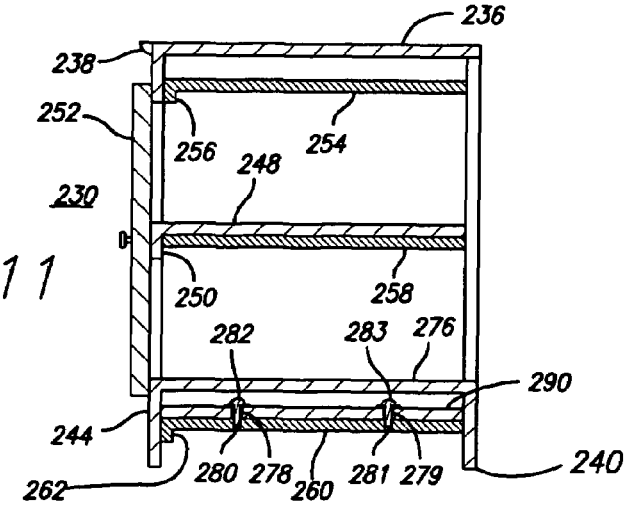
FIG. 11 is a right sectional view through a cabinet thereof taken along line 11-11 of FIG. 9.

FIG. 11, a right sectional view through a cabinet thereof, shows the top 236, top detail molding 238, bottom 240, middle shelf 248, middle shelf detail molding 250, door 252, top extension 254, middle extension 258, and bottom extension 260. The top extension 254 has a frontal depending top extension detail molding 256. The bottom extension 260 has a frontal depending bottom extension detail molding 262. The bottom 240 forms a bottom shelf 276 and a false bottom panel 290 having two parallel laterally oriented slots 278 and 279. The bottom extension 260 has two bolts 280 and 281 which are shown projecting upward into the slots 278 and 279 with their heads 282 and 283 above the false bottom panel 290 to slidably suspend the bottom extension 260 from the false bottom panel 290.

With reference to FIGS. 9-11, the first cabinet 232 and second cabinet 234 may be placed in abutment or they may be spaced apart a variable distance. To accommodate the distance, the top extension 254 slides in the top cut-out (not shown; see top cut-out 72 in FIG. 4), the middle extension 258 slides in the middle cut-out (not shown; see middle cut-out 74 in FIG. 4), and the heads 282 and 283 of the bolts 280 and 281 of the bottom extension 260 slide on the false bottom panel 290.

With continued reference to FIGS. 9-11, the heads 282 and 283 of the bolts 280 and 281 are hidden, because they engage with the false bottom panel 290 rather than the bottom shelf 276.

Figure 12:
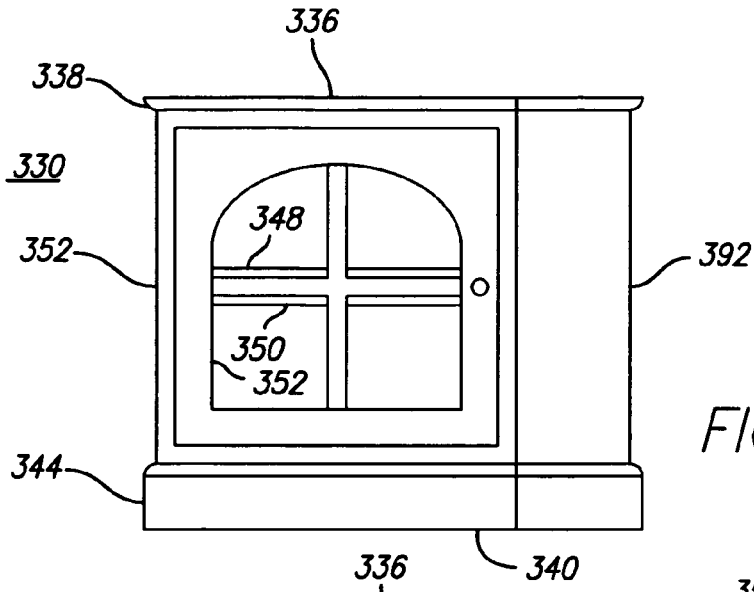
FIG. 12 is a front elevational view of a third alternative embodiment of an expandable cabinet furniture in accordance with the present invention with a column abutting a cabinet.

FIG. 12 illustrates a front elevational view of a third alternative embodiment of an expandable cabinet furniture in accordance with the present invention in which a support or column abuts one cabinet. This third alternative embodiment, shown generally by the number 330, includes a first cabinet 332 having a top 336 with frontal depending top detail molding 338, a bottom 340 with frontal depending bottom detail molding 344, a middle shelf 348 with frontal depending middle shelf detail molding 350, and a windowed door 352. A column 392 abuts the first cabinet 332.

Figure 13:
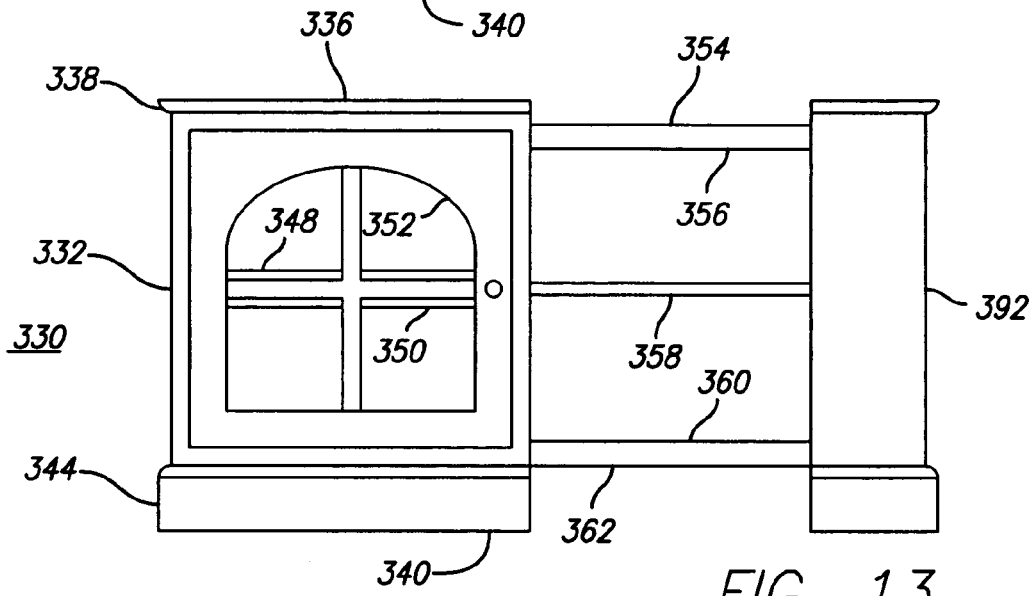
FIG. 13 is a side elevational view thereof with the column spaced apart from the cabinet.

FIG. 13, a side elevational view thereof with the column 392 spaced apart from the cabinet, shows the first cabinet 332, top 336, top detail molding 338, bottom 340, door 352, middle shelf 348, and middle shelf detail molding 350. A top extension 354 with top extension detail molding 356, a middle extension 358, and a bottom extension 360 with bottom extension detail molding 362 are shown between the spaced apart first cabinet 332 and column 392.

With reference to FIGS. 12-13, the first cabinet 332 and the column 392 may be placed in abutment or they may be spaced apart a variable distance, although not as far apart as with the other embodiments, there being less space for receiving each extension. To accommodate the distance, the top extension 354 slides in the top cut-out (not shown; see top cut-out 72 in FIG. 4), the middle extension 358 slides in the middle cut-out (not shown; see middle cut-out 74 in FIG. 4), and the bottom extension 360 slides on a front rail (not shown; see front rail 68 in FIG. 3) and a rear rail (not shown; see rear rail 70 in FIG. 3) or by means of bolts (not shown; see bolts 180 and 181 in FIGS. 7-8) on a bottom shelf (not shown; see bottom shelf 176 in FIGS. 7-8) or false bottom panel (not shown; see false bottom panel 290 in FIG. 11).

With continued reference to FIGS. 12-13, it is noted that the previous discussions of FIGS. 1-4, 5-8, and 9-11 are alternatively applicable to this third alternative embodiment.

Figure 14:
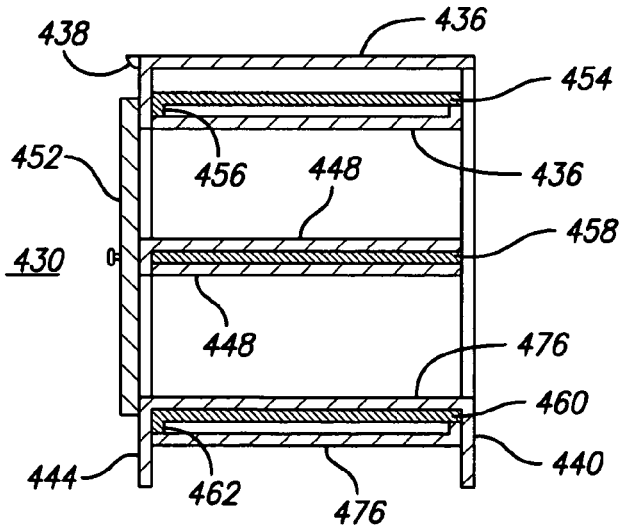
FIG. 14 is a right sectional view through one cabinet of a fourth alternative embodiment of the present invention.

FIG. 14 illustrates a right sectional view through a cabinet of at fourth alternative embodiment of the present invention in which extensions are received in hollow shelves. Shown generally by the number 430, this fourth alternative embodiment includes a hollow top 436, top detail molding 438, bottom 440, hollow middle shelf 448, door 452, top extension 454, middle extension 458, and bottom extension 460. The top extension 454 has a frontal depending top extension detail molding 456. The bottom extension 460 has a frontal depending bottom extension detail molding 462. The bottom 440 forms a hollow bottom shelf 476. The top extension 454, middle extension 458 and bottom extension 460 are slidably received and supported through top, middle and bottom cutouts (not shown; for structure, see top cut-out 72 and middle cut-out 74 in FIG. 4.) and received in and surrounded by the hollow top 436, hollow middle shelf 448 and hollow bottom shelf 476, respectively. In this fourth alternative embodiment, it is noted that there is no need for rails or bolts, because extensions 454, 458 and 460 are surrounded by the top 436 and the shelves 448 and 476, respectively.

While the foregoing detailed description has described several embodiments of an expandable cabinet furniture in accordance with the present invention, it is to be understood that the above description is illustrative only and not limiting of the disclosed invention. For example, the top, middle shelf, or bottom shelf may be hollow and serve to receive, support and guide an extension. Washers may be used with bolts. More or less than two slots may be employed in a bottom shelf or false bottom for supporting the bottom extension. The bottom extension may be received above a false bottom, rather than below it. The backs and sides of the cabinets may be relatively closed, as illustrated, or relatively open. The back panel may be fixed to a cabinet and may be able to slide with respect to another cabinet. Moldings, doors, and windows may be varied in size or shape. The extensions, although shown as relatively flat shelf-like structures, could have other shapes. An extension may be received through one side of a cabinet, as illustrated, or through more than one side. A cabinet may describe a substantially rectangular solid, as illustrated, or a wedge or a triangular solid. An extension need not be received through parallel sides of a cabinet or cabinets. Feet may be replaced by wheels or casters. The present invention may be formed of wood, glass, metal, polymers, composites, or other materials suited to the application. Indeed, it will be appreciated that the embodiments discussed above and the numerous embodiments that are not mentioned could easily be within the scope and spirit of the present invention. Thus, the present invention is to be limited only by the claims as set forth below.

What is claimed is:

1. An expandable television cart, comprising:

first and second cabinets each having a top side, each having a bottom side adapted for resting on a floor surface, each enclosing an interior space, each having a front side adapted for frontally viewing and accessing said interior space;

a top bridge extending between said first and second cabinets, variable portions of said top bridge being received within said first and second cabinets proximate the top sides thereof; and a bottom bridge extending between said first and second cabinets, variable portions of said bottom bridge being received within said first and second cabinets proximate the bottom sides thereof, wherein said variable portions of said top bridge and of said bottom bridge, received within said first and second cabinets, are substantially hidden from frontal viewing, wherein said first and second cabinets may be placed immediately adjacent to one another while enclosing and concealing from frontal viewing said top bridge and said bottom bridge completely within said first and second cabinets, and further wherein said variable portions of said top bridge and said bottom bridge received and enclosed within said interior space are continuously variable from completely extended to completely enclosed.

2. An expandable television cart as set forth in claim 1, wherein each of said first and second cabinets has at least one shelf at an intermediate height within said interior space, wherein at least one intermediate bridge extends between said first and second cabinets, variable portions of said intermediate bridge being received within said first and second cabinets proximate said intermediate shelves thereof, and wherein said variable portions of said intermediate bridge, received within said first and second cabinets, are substantially hidden from frontal viewing.

3. An expandable television cart as set forth in claim 2, wherein a molding depends frontally from said intermediate shelf of each of said first and second cabinets and wherein said variable portion of said intermediate bridge is received behind said molding.

4. An expandable television cart as set forth in claim 1, wherein a molding depends frontally from said top side and from said bottom side of each of said first and second cabinets and wherein said variable portion of said top bridge and said bottom bridge is received behind said molding.

5. An expandable television cart as set forth in claim 1, wherein a back panel extends between said first and second cabinets, and wherein a variable portion of said back panel is received behind at least one of said first and second cabinets.

* * * * *